US005506572A

United States Patent [19]

Hills et al.

[11] Patent Number: 5,506,572

[45] Date of Patent: Apr. 9, 1996

[54] LOW BATTERY DETECTION SYSTEM

[75] Inventors: Vernon E. Hills; Gary L. Kolbeck, both of Sioux Falls, S. Dak.

[73] Assignee: LodgeNet Entertainment Corporation, Sioux Falls, S. Dak.

[21] Appl. No.: 81,933

[22] Filed: Jun. 23, 1993

[51] Int. Cl.[6] ..... G08B 21/00

[52] U.S. Cl. ..... 340/636; 340/539; 340/635; 320/2; 320/48

[58] Field of Search ..... 340/635, 636, 340/539; 320/2, 48

[56] References Cited

U.S. PATENT DOCUMENTS

| | | | |
|---|---|---|---|
| 4,067,000 | 1/1978 | Carlson | 340/636 X |
| 4,418,416 | 11/1983 | Lese et al. | 375/5 |
| 4,461,013 | 7/1984 | Lese et al. | 375/65 |
| 5,012,973 | 5/1991 | Dick et al. | 236/46 |
| 5,239,286 | 8/1993 | Komatsuda | 340/636 |
| 5,293,526 | 3/1994 | Takahashi | 340/636 |

FOREIGN PATENT DOCUMENTS 2847052 4/1980 Germany .

1-114298 5/1989 Japan .

*Primary Examiner*—John K. Peng
*Assistant Examiner*—Edward Lefkowitz
*Attorney, Agent, or Firm*—Kinney & Lange

[57] ABSTRACT

A low battery detection system for detecting the battery voltage level in a remote control unit of a hotel entertainment system comprises a detection circuit imbedded within the remote control unit. Information regarding the battery voltage status is transmitted to a guest television terminal along with the infrared signal which turns the television on or off. A central computer polls each guest television terminal associated with an individual guest room to determine whether the battery in the remote control unit needs to be replaced. A system for generating a list of remote control units identified by guest room, which needs fresh batteries is also provided. In this manner, hotel personnel can detect and replace batteries in remote control units which are prone to impending battery failure without guest complaints. Further, the parameters which determine whether a battery needs to be replaced can be altered by the user of the system.

5 Claims, 2 Drawing Sheets

LOW BATTERY DETECTION SYSTEM

BACKGROUND OF THE INVENTION

The present invention relates to hotel entertainment systems. More particularly, the present invention relates to low battery level detection circuits in remote control units of hotel television and/or pay-per-view movie systems.

In the hotel business, maximizing guest satisfaction is a priority. Any customer dissatisfaction or guest frustration can cause complaints which ultimately result in a loss of revenue. One area in which the hotel guest expects a high standard of performance is in the proper functioning of entertainment equipment provided in the guest room.

The hotel television and pay-per-view movie system is both a source of entertainment for the guest and a means to collect revenue for the hotelier. These video entertainment systems usually come equipped with a hand-held remote control unit to provide increased comfort to the guest. The hand-held remote control units used in hotels are essentially the same units provided for residential use. Contrary to the residential user, however, the transient hotel guest does not use the same remote control unit for an extended period of time. Therefore, the hotel guest does not know the history of the remote control unit and cannot accurately infer that an occasional malfunction of the remote control unit is an indication of impending battery failure. Also, the transient guest may not be familiar with the key functions and pointing characteristics of a particular remote control unit.

Coping with a low battery level in a remote control unit, as well as new characteristics of the unit, can be a source of frustration for the hotel guest. Since hotel management wants all guests to be satisfied, the batteries must be kept fresh so as to satisfy even the pickiest residential user. Conventional systems of battery testing have relied on guest complaints or periodic operation of the remote control unit in each guest room by the housekeeping staff or other hotel personnel, in order to detect end-of-life batteries. However, operation by hotel personnel is not always a reliable indicator as a battery that has rested for a prolonged period of time may operate properly for the short amount of time that the hotel personnel is testing it. However, the same battery may fatigue under more extensive, but quite normal use.

SUMMARY OF THE INVENTION

In a hotel television system, which works in conjunction with a pay-per-view movie system, the present invention provides a battery level detection circuit imbedded within a hand-held remote control unit of the television system to check the battery voltage under actual guest operation conditions. The results of the battery check are relayed to a guest terminal, and then to a central computer. Based on the results relayed to the central computer, hotel personnel is supplied with a report listing rooms with impending battery failure.

The invention includes a low power, low voltage comparator circuit within the remote control unit of the television system. To prevent additional battery drain by the low battery detection circuit from adversely affecting battery life of the remote control unit, the circuit is activated only when the on/off key of the unit is pressed. When the on/off key is pressed, the comparator circuit is powered. There are no excess hard wire connections associated with the detection circuit. Instead, the same infrared signal which is encoded to turn the television "on" or "off" carries additional information, i.e. the battery voltage status of the remote control unit to the central computer.

Battery voltage detection begins when the comparator circuit compares the actual battery voltage of the remote control unit with a fixed built-in voltage reference in the comparator. If the actual voltage is less than the voltage reference, a "low" battery voltage indication will occur. The battery voltage status information, or the output of the comparator circuit, is then fed into a microprocessor of the remote control unit which is responsible for transmitting infrared remote control signals to the television or guest terminal. The guest terminal may be any form of entertainment system including a television, pay-per-view or stereo system. When the on/off key is pressed, the guest terminal not only responds to the command of the remote control unit, it also receives and stores the battery voltage status information encoded in the infrared signal which contains the on/off command.

Next, a central computer polls each guest terminal, using an existing link established for billing purposes, to obtain the battery voltage status obtained in the remote control unit located in each individual guest room. In one preferred method of low battery detection, if the central computer detects one "low" battery voltage status from any particular remote control unit, the remote control unit is identified by room and placed on a report which is generated for hotel personnel indicating which rooms require fresh batteries. In another preferred method of low battery detection, the central computer polls, over an extended period of time, each guest terminal to obtain the battery voltage status of the remote control unit which operates that guest terminal. Each "low" battery voltage indication is stored in the guest terminal and relayed to the computer by the existing billing link. If the frequency of "low" indications exceeds a threshold value for any given remote control unit, it is determined that the batteries of that remote control unit need to be replaced. Thus, the remote control unit is identified by room and placed on a report generated for hotel personnel to take appropriate action.

The present invention allows the hotel to replace batteries of the remote control unit without any additional hard wiring and without guest complaints. It assures that revenue will not be lost because of poor remote control operation due to low batteries.

DETAILED DESCRIPTION OF THE PREFERRED EMBODIMENTS

In each hotel room, it is common to find a remote control unit and a television and/or pay-per-view movie system. The television system (i.e. guest terminal) is operated by the remote control unit.

The remote control unit provided in each guest room is a hand-held unit with a key board. The remote control unit allows the guest to operate the television from any point in the room within a range of a remote control signal which is sent by the remote control unit to the television. The remote control signal, which may take the form of an infrared signal, operates many of the functions of the television. For example, a guest may decrease the volume, make another channel selection or turn the television off, even while lying in bed. A microprocessor or remote control transmission chip of the remote control unit receives key inputs from the keyboard of the unit and generates the remote control signals which are sent to the television. There are no hard wire links between the remote control unit and the television terminal. Thus, the guest enjoys mobility while viewing the television.

Although most television programming is available to the hotel guest free of charge, there are some channel selections, such as movies, for which the guest is charged per viewing. In order to bill the guest for viewing these particular channel selections, the guest terminal (or television) is linked by cable to a central computer which receives signals, for billing purposes, whenever a non-complimentary channel is selected. The central computer tracks the charges which accrue from each individual guest room and compiles these charges for payment at check-out. The present invention uses existing remote control units and central computer cable links to inform hotel personnel which remote control units require fresh batteries.

Figure 1:
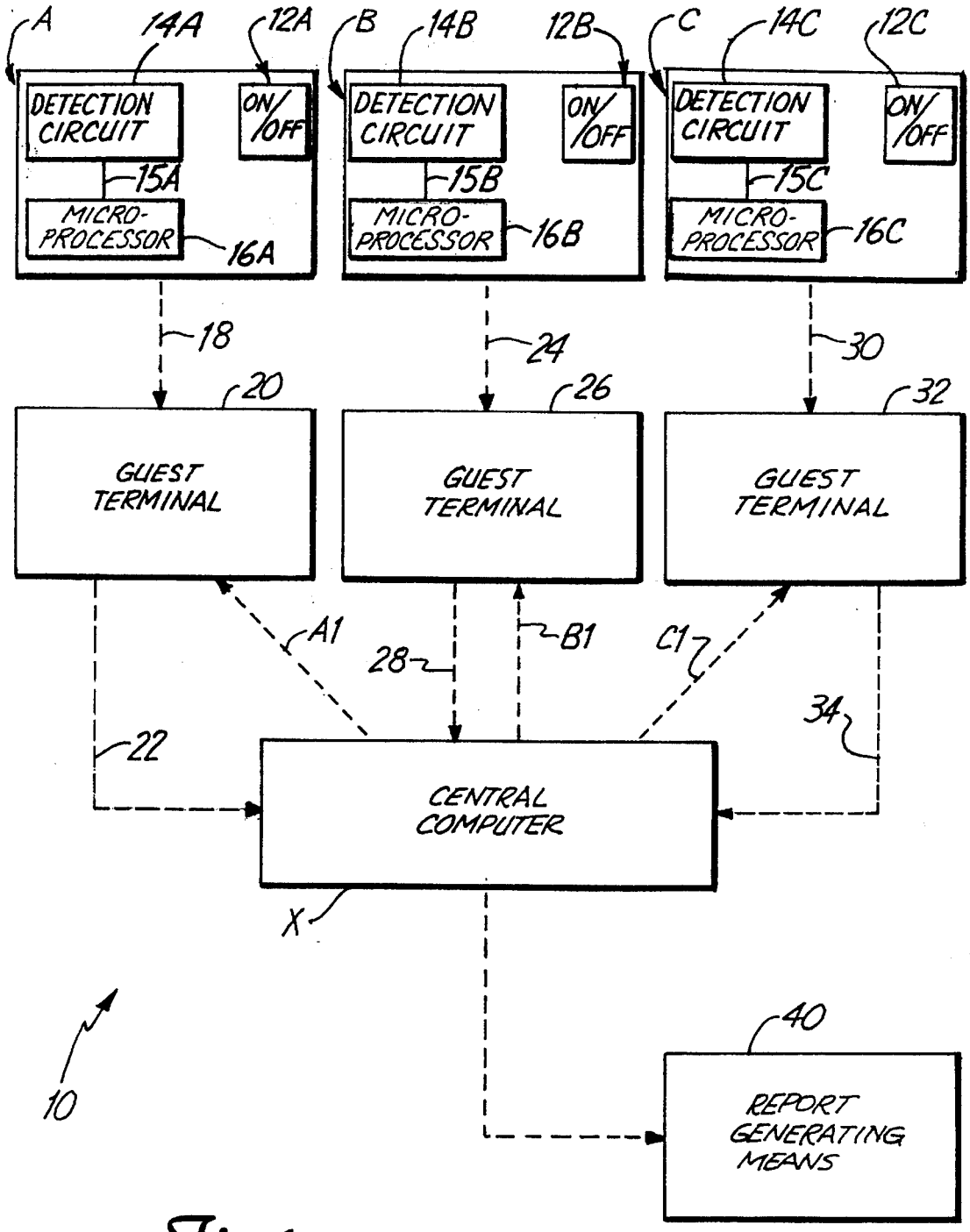
FIG. 1 shows a block diagram of a preferred embodiment of the low battery detection system of the present invention.

FIG. 1 shows a block diagram of one preferred embodiment of the present invention. Specifically, low battery detection system 10 is shown to include remote control unit A, remote control unit B and remote control unit C. Each remote control unit A, B and C is found in a guest room to operate corresponding guest terminals (e.g. televisions) 20, 26 and 32, respectively. Each remote control unit A, B and C includes on/off key 12A, 12B, 12C, detection circuit 14A, 14B, 14C and microprocessor 16A, 16B, 16C, respectively. A remote control transmission chip could be substituted for microprocessor 16A.

In operation, when a predetermined key is pressed, such as on/off key 12A, for example, detection circuit 14A compares the actual battery voltage of remote control unit A with its own built-in voltage reference. If the battery voltage level of remote control unit A is less than the built-in voltage reference of detection circuit 14A, a "low" battery voltage indication is fed into input pin 15A of microprocessor 16A of remote control unit A. After on/off key 12A is pressed, microprocessor 16A emits infrared signal 18. Infrared signal 18 carries encoded battery voltage status information, and responds to the on/off command emitted by microprocessor 16A, by turning guest terminal 20 "on" or "off." Guest terminal 20 receives and stores the battery voltage status information carried by infrared signal 18.

Periodically, central computer X polls guest terminal 20 via outbound signal A1. Outbound signal A1 travels from central computer X to guest terminal 20 over the same cable link used for billing noncomplimentary entertainment. However, the information contained in outbound signal A1 requests the battery voltage status information which is stored by guest terminal 20. Guest terminal 20 responds to control computer X by transmitting inbound signal 22, which indicates the battery voltage status information, back to central computer X, over the same cable link. Central computer X receives inbound signal 22 and stores the battery voltage status information. If inbound signal 22 contains information indicating a "low" battery voltage status, central computer X denotes remote control unit A as a unit requiring fresh batteries. All remote control units which require fresh batteries are then down-loaded to report generating means 40 to be placed on a list for hotel personnel.

Remote control units B and C operate in a similar manner in that when on/off keys 12B or 12C are pressed, detection circuits 14B and 14C compare the actual battery voltage of remote control units B and C, respectively, with a built-in voltage reference. The battery voltage status is detected and the information is inputted to remote control microprocessor 16B or 16C via input pins 15B or 15C, respectively.

After depressing on/off key 12B of remote control unit B, infrared signal 24 carries encoded battery voltage status information along with the on/off command to guest terminal 26. Guest terminal 26 responds to the on/off command by either turning guest terminal 26 "on" or "off" and stores the battery voltage status information. Guest terminal 26 stores the battery voltage status until it is polled by central computer X via outbound signal B1. Outbound signal B1 is transmitted over the cable link used to distribute signals for billing purposes. The battery voltage status such as a "low" battery voltage indication is then transmitted to central computer X by guest terminal 26 via inbound signal 28 which travels back over the cable link used for billing. Remote control units with a "low" battery indication are placed on a list corresponding to individual guest rooms. The list is then down-loaded to report generating means 40 for use by hotel personnel.

Similarly, after on/off key 12C of remote control unit 12C is pressed, information encoded with the battery voltage status of remote control unit C and the on/off command is transmitted by infrared signal 30 to guest terminal 32. Guest terminal 32 responds to the on/off command and stores the battery voltage status information until it is polled by central computer X via outbound signal C1. Outbound signal C1 travels over the cable link used for billing purposes. Guest terminal 32 responds to signal C1 by transmitting inbound signal 34 back to central computer X. Inbound signal 34 carries the battery voltage status information. Remote control units with "low" battery voltage indications are identified and stored by central computer X. The information is then down-loaded to report generating means 40 so that hotel personnel can be alerted that the batteries in remote control unit C need to be replaced.

In another preferred embodiment of the present invention, central computer X polls remote control units A, B, and C over a period of time, thereby receiving multiple indications of battery voltage status. If the frequency of "low" battery voltage indications from a given remote control unit exceeds a threshold value, the remote control unit is identified and down-loaded to report generating means 40 to be placed on a list for hotel personnel to take appropriate action. The threshold value can be changed to compensate for differing characteristics of batteries which vary from brand to brand.

In other applications of the present invention, messages from the guest terminal which indicate a low battery voltage could be communicated to an entertainment system user by visual displays or audible signals.

Figure 2:
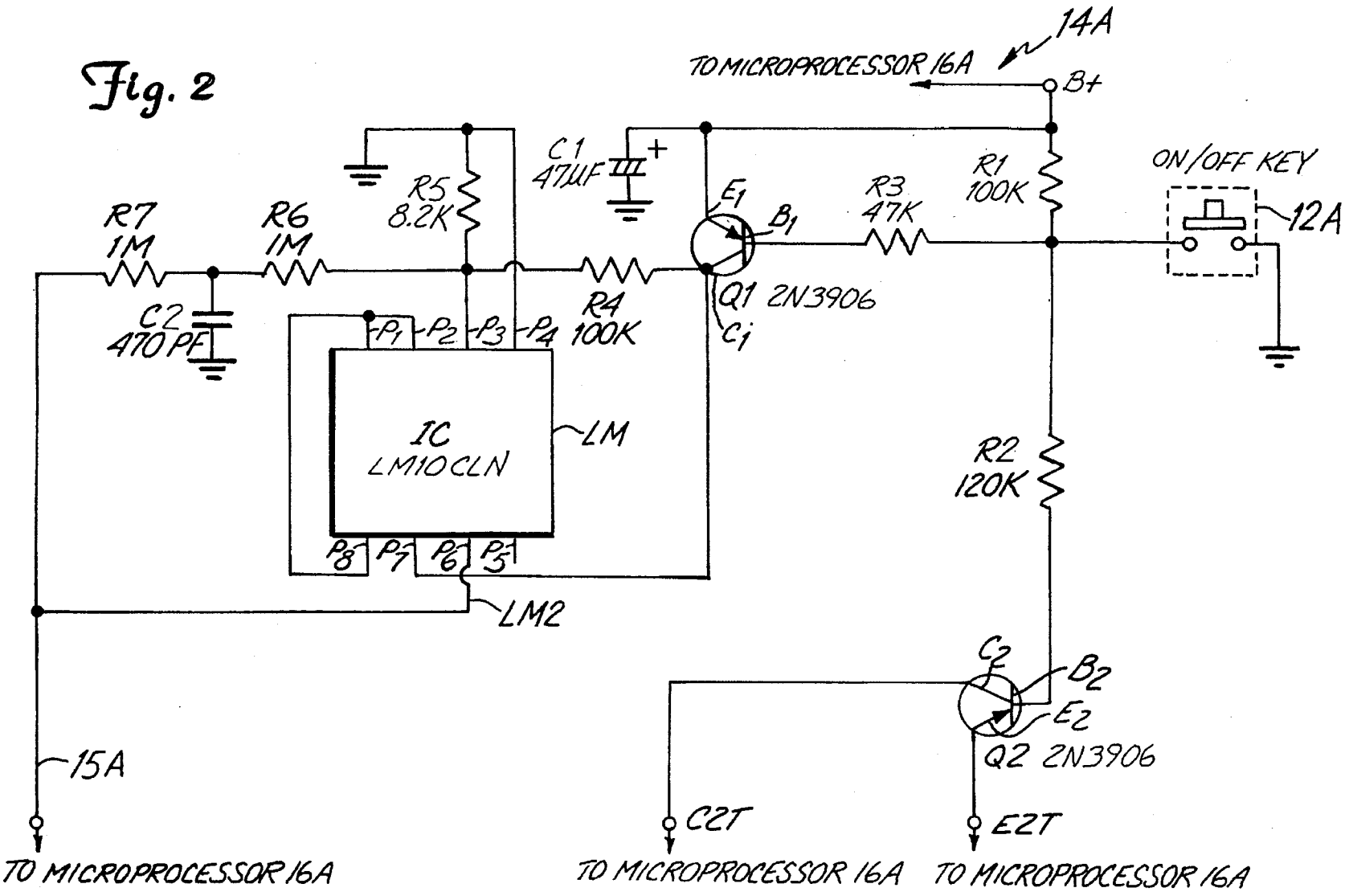
FIG. 2 shows the low battery detection circuit imbedded within a remote control unit of the present invention.

FIG. 2 shows a preferred embodiment of detection circuit 14A shown in FIG. 1. Correspondingly, detection circuits 14B and 14C (not shown) are identical. Detection circuit 14A includes on/off key 12A, resistors R1, R2, R3, R4, R5, R6 and R7, transistors Q1 and Q2, capacitors C1 and C2, comparator LM and battery B+. Also shown are comparator LM input pins P1, P2, P3, P4, P5, P6, P7, terminals C2T, E2T, transistor bases $B_1$ and $B_2$, collectors $C_1$ and $C_2$ and emitters $E_1$ and $E_2$ and microprocessor input pin 15A. Comparator LM is a National Semiconductor P/N LM10CLN low power, low voltage comparator device with a built-in voltage reference.

When on/off key 12A is pressed, typically, remote control microprocessor 16A would issue either an "on" or "off" infrared signal from remote control unit A. However, since the battery voltage status information is being inputted to an on/off pin of remote control microprocessor 16A (not shown), the on/off command is now issued by PNP transistors Q1 and Q2. Transistor Q1 is shown to include emitter $E_1$, base $B_1$ and collector $C_1$. Transistor Q2 is shown to include emitter $E_2$, base $B_2$ and collector $C_2$.

Specifically, emitter terminal E2T and collector terminal C2T of transistor Q2 are attached to input pins 1 and 19 (not shown) of microprocessor 16A. Transistor Q2 issues the "on" or "off" command of remote control unit A. When the on/off key 12A is in the "off" position, the base voltage of transistor base $B_2$ of transistor Q2 is high and Q2 issues an "off" command to microprocessor 16A. When on/off key 12A is in the "on" position, the base voltage of $B_2$ is low and current is supplied to transistor Q2. When transistor Q2 is supplied with current, the "on" command, is inputted to microprocessor 16A via terminals C2T and E2T.

Transistor Q2 works in conjunction with transistor Q1. When Q2 gives the "on" or "off" command to microprocessor 16A, current flows through resistor R3 to base $B_1$ of transistor Q1. Emitter $E_1$ of transistor Q1 is connected to battery B+. When transistor Q1 saturates, it effectively puts the battery voltage B+ into input pin P7 of comparator LM via collector $C_1$. Pin P7 is the power supply input of comparator LM. Transmitter Q1 serves a power saving purpose. In other words, if Q1 were saturated at all times, it would adversely affect the battery life of remote control unit A. Therefore, Q1 saturates only when on/off key 12A is pressed, thereby inputting the battery voltage status of battery B+ into input pin P7 of comparator LM. Thus, the only time that the detection circuit is activated is when on/off key 12A is pressed. Capacitor C1 is used as a bypass to take away any minor voltage variation which might be introduced into input pin P7 by microprocessor 16A.

Once Q1 has powered comparator LM, LM compares two voltages. Namely, LM compares battery voltage B+ and an internal voltage reference inside comparator LM. The voltage of battery B+ is inputted into comparator LM via input pin P3. Resistors R4 and R5 serve as a voltage divider network to scale the battery voltage of battery B+ before it is inputted into pin P3. Approximately 8 to 10 percent of battery voltage B+ is inputted to pin P3. Once the battery voltage is inputted, comparator LM compares the battery voltage of B+ with an internal voltage reference. The result of that comparison is outputted from pin P6 of comparator LM and is fed down into microprocessor 16A via input pin 15A. In addition to being fed into microprocessor 16A, results of the battery voltage and internal voltage reference comparison are fed back through resistors R6 and R7 in order to provide hystersis to prevent oscillations which may occur. Capacitor C2 is provided to ensure that a purely DC feedback signal is inputted into pin P3. Input pins P1 and P8 of comparator LM are connected in order to provide a unity gain amplification of the reference voltage contained within comparator LM. This amplification of the reference voltage is then fed back into comparator LM via input pin P2. The voltage on input pin P2 is then compared with the voltage on input pin P3. Recall that the voltage on input pin P3 is the scaled battery voltage of battery B+ of remote control unit A. Input pin P5 is not used.

Once the comparison is complete, the results of the comparison are outputted from LM pin P6 into input pin 15A of microprocessor 16A of remote control unit A. If the voltage of pin P3 is less than the value of the voltage of pin P2, a "low" battery indication is encoded into the "on" or "off" infrared command signal sent by microprocessor 16A.

The present invention provides significant advantages over conventional methods of determining the need for battery replacement in remote control units. Foremost is that hotel personnel do not need to rely on guest complaints to replace batteries in the individual remote control units. Further, by utilizing a predetermined key of the remote control unit to provide battery voltage status information to a central computer, the low battery detection system is invisible to the end user. Further, the threshold of failure level in the preferred embodiment of the invention can be altered by hotel personnel to compensate for different characteristics of various brands of batteries. Finally, a means to generate a report indicating which remote control units require fresh batteries is convenient for hotel personnel as the data can be compiled and available for use by only one person as opposed to conventional methods of utilizing the entire housekeeping staff or various members of hotel personnel to determine whether the batteries in a particular remote control unit need to be replaced.

Although the present invention has been described with reference to preferred embodiments, workers skilled in the art will recognize that changes may be made in form and detail without departing from the spirit and scope of the invention.

What is claimed is:

1. A low battery voltage detection system in a hotel entertainment arrangement based on a network which extends from a central location to a plurality of remote locations with there being a central controller located at the central location for transmitting video information signals on the network to, and for communicating over the network to obtain information from, devices connected to the network at the remote locations, the low battery voltage detection system comprising:

a plurality of guest terminals each connected to the network at one of the remote locations and each having a video display to present information provided by the video information signals received over the network from the central controller, and each being capable of receiving signals generated at said remote location thereof;

a plurality of battery operated transmitters each corresponding to one of the plurality of guest terminals for transmitting signals thereto that in part control the video information presented on the video display of the corresponding guest terminal, and each having a battery and a voltage detector for detecting a battery voltage value therein, each battery operated transmitter being capable of transmitting battery status information based on battery voltage values detected by the voltage detector therein to its corresponding guest terminal to be stored therein and to be obtainable by the central controller communicating with that guest terminal over the network; and a list displayer located at the central location under control of the central controller, the list displayer for providing a list of transmitters having a selected voltage status.

2. The low battery detection system of claim 1 wherein each battery operated transmitter has a plurality of function keys and each voltage detector is activated to detect a battery voltage value in a battery operated transmitter only when a function key of the battery operated transmitter is pressed.

3. The low battery detection system of claim 1 wherein each battery operated transmitter has a plurality of function keys and each battery operated transmitter transmits battery status information only when a function key of the battery operated transmitter is pressed.

4. The low battery detection system of claim 1 wherein the central controller receives a plurality of low battery voltage indications from a guest terminal over a period of time, the central controller compares the frequency of low battery voltage indications with a threshold value, and the central controller identifies the battery operated transmitter corresponding to that guest terminal as a transmitter with a low battery level is the frequency of low battery indications exceeds the threshold value.

5. The low battery detection system of claim 4 wherein the threshold value is adjustable.

* * * * *